US005321864A

United States Patent [19]

Holderer

[11] Patent Number: 5,321,864

[45] Date of Patent: Jun. 21, 1994

[54] CONTINUOUS METHOD AND INSTALLATION FOR BLEACHING A TEXTILE FABRIC WEB

[75] Inventor: Horst Holderer, Krefeld, Fed. Rep. of Germany

[73] Assignee: Eduard Küsters Maschinenfabrik GmbH & Co. KG, Krefeld, Fed. Rep. of Germany

[21] Appl. No.: 106,688

[22] Filed: Aug. 16, 1993

Related U.S. Application Data

[63] Continuation of Ser. No. 920,312, Aug. 12, 1992, abandoned.

[30] Foreign Application Priority Data

Feb. 26, 1990 [DE] Fed. Rep. of Germany ..... 4005979

[51] Int. Cl.[5] ..... D06B 3/12

[52] U.S. Cl. ..... 8/149.1; 8/151; 8/158; 68/5 D; 68/9; 68/181 R

[58] Field of Search ..... 8/149.1, 151, 158; 68/5 D, 5 E, 9, 27, 181 R

[56] References Cited

U.S. PATENT DOCUMENTS

| | | | |
|---|---|---|---|
| 3,722,233 | 3/1973 | Windhorst | 68/5 |
| 3,807,950 | 4/1974 | Rogers | 8/175 |
| 3,961,503 | 6/1976 | Grantham | 68/9 X |
| 4,479,370 | 10/1984 | Wang | 68/22 R |
| 4,546,511 | 10/1985 | Kaufmann | 68/27 X |

FOREIGN PATENT DOCUMENTS

| | | | |
|---|---|---|---|
| 0316859 | 5/1989 | European Pat. Off. . | |
| 1816483 | 6/1970 | Fed. Rep. of Germany . | |
| 1941674 | 2/1971 | Fed. Rep. of Germany . | |
| 2002971 | 7/1971 | Fed. Rep. of Germany . | |
| 3200146 | 10/1982 | Fed. Rep. of Germany . | |
| 3119869 | 10/1983 | Fed. Rep. of Germany . | |
| 3324650 | 1/1985 | Fed. Rep. of Germany . | |
| 3346690 | 7/1985 | Fed. Rep. of Germany | 68/27 |
| 3739346 | 6/1989 | Fed. Rep. of Germany . | |
| 3511949 | 3/1991 | Fed. Rep. of Germany . | |
| 0063454 | 11/1968 | German Democratic Rep. . | |
| 2051155 | 1/1981 | United Kingdom . | |

OTHER PUBLICATIONS

Melliand Textilberichte 61 (1980), Horst Holderer, Krefeld, published by Melliand Textilberichte KG, Heidelberg, FRG, pp. 258-261.

*Primary Examiner*—Philip R. Coe
*Attorney, Agent, or Firm*—Kenyon & Kenyon

[57] ABSTRACT

A washing unit includes several individual washing machines that adjoin the ager of a continuous bleaching installation. The washing machines immediately following the ager are operated in a co-current flow manner and receive between 10%-50% of the washing liquor conveyed through the remaining washing machines, which are operated in a counter-flow manner.

4 Claims, 1 Drawing Sheet

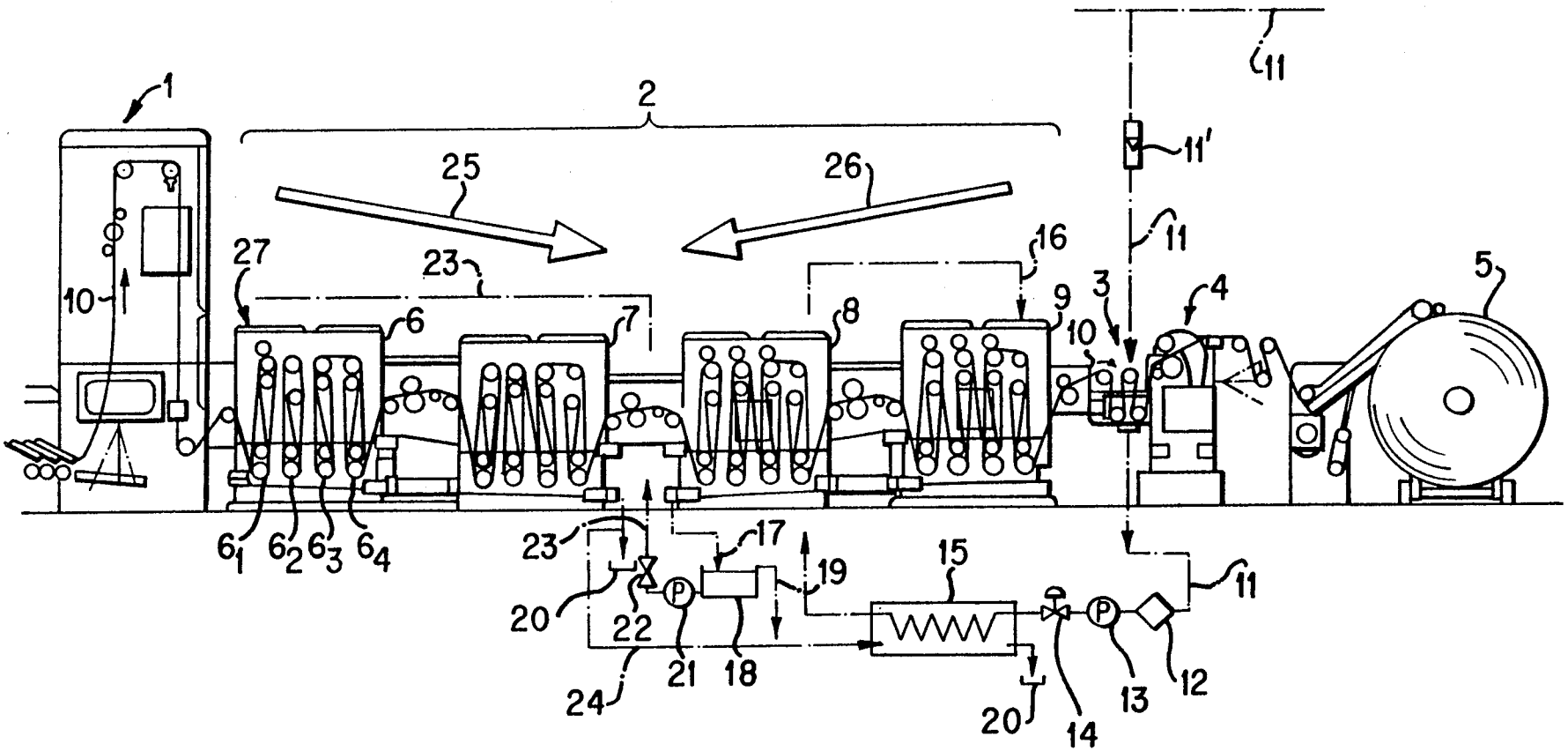
1
2
3
4
5
6
6₁
6₂
6₃
6₄
7
8
9
10
11
11'
12
13
14
15
16
17
18
19
20
21
22
23
24
25
26
27

CONTINUOUS METHOD AND INSTALLATION FOR BLEACHING A TEXTILE FABRIC WEB

This application is a continuation of application Ser. No. 07/920,312, filed Aug. 12, 1992, now abandoned.

BACKGROUND OF THE INVENTION

The present invention relates generally to a continuous method and installation for bleaching a textile fabric web, and more particularly to a continuous method and installation for bleaching a textile fabric web having improved hydrophilic properties.

In a bleaching process, a bleaching liquor, which contains for example, a sodium hydroxide solution and peroxide, is applied, after a prewashing step, to a textile fabric web made entirely or mostly of cotton. The bleaching liquor acts on the fabric web in a steaming machine for a specified dwell time. The applied chemicals and the dissolved substances are subsequently removed from the fabric web by an intensive washing process. The web is then ready for the dyeing process.

This known, standard-type process produces a fabric web having a good degree of whiteness and freedom from shells or husks, but it results in hydrophilic properties that often leaves much to be desired. This means that the fabric web does not absorb the dye liquor vigorously enough. The hydrophilic property is determined by how much of the wax and grease found on the cotton fiber can be dissolved by the NaOH treatment. If the quantity dissolved is not quite complete so that some of the wax and grease remain on the fabric web, the hydrophilic property of the web is inferior and, accordingly, the liquid dye is poorly absorbed.

After the fabric web traverses the steaming machine, the applied chemicals are not yet completely spent. Rather, a certain portion of residual chemicals remains on the fabric web when it enters the washing unit.

The washing unit is formed from several individual washing machines, which are arranged one behind the other and which may be designed as roller vats, for example. In known installations, this type of series of washing machines is operated according to the counter-flow principle for economic reasons. The term "counter-flow" means that the fresh water is added at the end of the row and flows in a direction opposite to the direction in which the fabric web is fed from one washing machine to the other. The fresh water is then conducted into the drain duct of the washing machine that is last relative to the direction of flow and first relative to the direction in which the fabric web is fed (DD-A-63 454; DE-C-3 119 869). Accordingly, with respect to the bleaching installation, the fabric web was confronted with a large supply of permeated liquid after traversing the steaming machine, which was at once drained off in the first washing machine. As a result, the residual chemicals on the fabric web were rinsed off and removed right at the beginning of the process.

The present invention is directed to the problem of improving the treatment of a fabric web in a bleaching installation to improve the hydrophilic properties of the fabric web.

SUMMARY OF THE INVENTION

The present invention provides a continuous method for bleaching a textile fabric web formed from a material having cotton as its major component. A bleaching liquor is applied to the fabric web and the fabric web is fed through a steaming machine. The fabric web is washed in a plurality of washing machines that are divided into a first series of washing machines nearest the steaming machine and a last series of washing machines. A flow of washing liquor is provided to the last series of washing machines which flows in a direction substantially opposite to the direction in which the fabric web is fed in the washing machines. At least a portion of the washing liquor flowing in the last series of washing machines is provided to an intake of a first washing machine in the first series of washing machines such that the washing liquor portion flows in a direction substantially the same as the direction in which the fabric web is fed in the washing machines. The washing liquor portion is removed at the end of the flow of washing liquor flowing in the last series of washing machines.

By directing the washing liquor so that it flows co-currently with the fabric web, the exhausted washing liquor is not drained off right at the beginning of the series of washing machines. Rather, the liquor is drained off later, as viewed relative to the direction of feed of the fabric web in the washing machines. Specifically, the washing liquor is removed at the boundary between the co-current flow section and the counter-flow section.

According to another aspect of the invention, all the partially exhausted washing liquid that accumulates at the end of the counter-flow section of the washing machines can be used at the beginning of the co-current flow section of the washing machines, which is located immediately after the steaming machine. However, it is advantageous to apply only a portion of all the washing liquid used in the counter-flow section to the beginning of the co-current flow section. The net result of these measures is that residual chemicals found on the fabric web are not rinsed off and then immediately drained off with a large supply of washing liquid. Rather, the residual chemicals are only subjected to an effectively diminished washing and thus they have an opportunity to continue working in the co-current flow section.

According to the present invention, the washing unit, which is formed from several washing machines, enables the dwell time of the residual chemicals (particularly the chemicals responsible for dissolving the wax and grease, especially the sodium hydroxide solution) to be artificially prolonged. Accordingly, the removal of the wax and grease is improved, resulting in good hydrophilic properties. As a result, in many cases the scouring stage, which uses NaOH and peroxide and which has conventionally been performed before the bleaching stage, can be eliminated. Thus, a true single-stage bleaching process can be achieved because NaOH and peroxide are applied together with, at most, a somewhat increased NaOH concentration and the fabric web is consequently fed through the steaming machine. Because of the refinement to the washing process provided by the present invention, the scouring stage, after which, of course, the NaOH again had to be washed out, usually can be eliminated. This refinement also provides an important advantage from the standpoint of reducing environmental problems. In the method of the present invention, as in known methods, a certain quantity of NaOH is in fact required to dissolve the wax and grease and is combined with the peroxide in a treatment liquor. However, NaOH is also present in the bleaching liquor when a scouring stage is used. Accordingly, the total amount of NaOH is reduced when the scouring stage is eliminated. Although one application of the present invention is to a bleaching process using NaOH and peroxide, the invention is not limited to this application.

From the Melliand Textile Reports (Melliand Textilberichte), 61 (1980), pp. 58 to 261, particularly page 260 under the heading Speed Neutrality (Geschwindigkeitsneutralität), point 2, it can be inferred that an intermediate section is to be inserted during the continuous bleaching process before the actual diluting wash, in which a transition is made from an initial liquor ratio of about 1:1 to a greater volume of solution, which also contains the washed-out NaOH. However, this reference does not suggest how to perform this procedure in practice.

When only a portion of the washing liquor from the counter-flow section is used for washing in the co-current flow section, this portion may be approximately 10–50% of the quantity of washing liquor flowing in the counter-flow section.

Therefore, the washing liquor used in the co-current flow section is already partially exhausted and contains the washed out residual chemicals, so that the fabric web is treated, so to speak, "in its own juice". Further, the residual chemicals that are contained in the washing liquor and which influence the hydrophilic property of the web, have a chance to act on the web after it leaves the steaming machine.

BRIEF DESCRIPTION OF THE DRAWING

The sole FIGURE illustrates a schematic side view of a continuous bleaching installation constructed according to the principles of the present invention.

DETAILED DESCRIPTION

The fabric web 10 first undergoes an intensive prewashing. Next, a bleaching liquor is applied, which may contain a sodium hydroxide solution and peroxide, for example. The thus charged fabric web 10 then completes a period of dwell in a steaming machine 1, the end portion of which is shown on the left side of the drawing. A washing unit 2 adjoins the steaming machine. The fabric web 10 subsequently runs through a rinse basin 3, as well as a roller squeezing apparatus 4 and, finally, is wound up into a fabric batch 5.

In the illustrated embodiment, the washing unit 2 includes four washing machines 6,7,8 and 9, which are connected in series in the direction in which the fabric web 10 is fed and which are designed as so-called roller vats. Each of the washing machines 6, 7, 8, and 9 are subdivided into four wash compartments, as indicated in the case of the washing machine 6, for example, by the reference numbers $6_1$, $6_2$, $6_3$ and $6_4$.

Fresh water is supplied via the line 11 and a filter 11' to a pump 13, which feeds the fresh water, via control valve 14 and heat exchanger 15 to a location indicated by reference numeral 16. Thus, the water is supplied to the last washing machine 9 at the end of the row of washing machines 6,7,8 and 9. The fresh water forms a washing liquor at the bottom of the washing machines 6,7,8 and 9, which flows in the washing machines 9 and 8 in a direction opposite to the running direction of the fabric web 10, as indicated by the arrows. As is apparent from the drawing, the water flows from the washing machine 9 into the washing machine 8, and is then drawn off at the intake of the washing machine 8 (which is determined with reference to the running direction of the fabric web 10) and conducted into an intermediate tank 18 via the line 17. The overflowing washing liquor in intermediate tank 18 is conducted to the heat exchanger 15 via line 19, and from there it is conducted to the drain duct 20. The washing liquor is heated in the washing machines 6,7,8 and 9 and has an elevated temperature. The heat is transferred to the added fresh water in the heat exchanger 15.

A portion of the washing liquor that arrives in the intermediate tank 18 is fed to the intake 27 (as determined by the running direction of the fabric web 10) of the washing machine 6 (i.e., at a point directly following the steaming machine 1) via the pump 21, the control valve 22 and the line 23. This portion of the washing liquor flows through the washing machine 6, and then the washing machine 7 and is either directly drained off at the outlet 28 into the drain duct or is conducted via line 24 through the heat exchanger and into the drain duct 20. Thus in the first washing machines 6 and 7, the fabric web 10 remains in a washing liquor that is already partially exhausted, which flows according to the direction of feed of the fabric web 10 and only discharges into the drain duct 20 at the outlet 28 of the washing machine 7. Thus, the fabric web 10 is not thoroughly rinsed right away in the washing machines 6 and 7. Rather, bleaching liquor that remains on the fabric web 10 has a chance to provide a residual aftereffect. In the intermediate section put through the washing machines 6 and 7, there is a transition from a liquor ratio of about 1:1 in the steaming machine 1 to a liquor ratio of about 1:2 to 1:4, i.e., that is, there is a transition to a larger volume of solution, which, however, still contains the already washed out NaOH.

The quantity of washing liquor drawn by the pump 21 from the intermediate tank 18 amounts to 10% to 50% of the washing liquor that has been conducted through the washing machines 8 and 9.

While the washing liquor in the washing machines 9 and 8 flows in a direction counter to the direction of feed of the fabric web 10, the flow volume in the washing machines 6 and 7 flows in a co-current direction that is the same as the direction of feed of the fabric web 10. Thus, the entire washing unit 2 is subdivided into a co-current flow section 25 immediately following the steaming machine 1 and a counter-flow section 26 contiguous to the first section, as indicated in the FIGURE by the large arrows.

I claim:

1. A continuous method for bleaching a textile fabric web formed from a material having cotton as its major component, said method comprising the steps of:

applying a bleaching liquor to the fabric web;

feeding the fabric web through an ager;

washing the fabric web in a plurality of washing machines divided into a first series of washing machines nearest the ager and a last series of washing machines, said washing step including:

providing a flow of washing liquor to the last series of washing machines which flows in a direction substantially opposite to the direction in which the fabric web is fed in the washing machines;

providing at least a portion of the washing liquor flowing in the last series of washing machines to an intake of a first washing machine in the first series of washing machines such that said washing liquor portion flows in a direction substantially the same as the direction in which the fabric web is fed in the washing machines; and removing said washing liquor portion at the end of the flow of washing liquor flowing in the least series of washing machines.

2. The continuous method of claim 1 wherein said portion of washing liquor provided to the intake of the first washing machine is approximately 10–50% of the quantity of washing liquor flowing in the last series of washing machines.

3. A continuous installation for bleaching a textile fabric web formed from a material having cotton as its major component, said installation comprising:

an applicator for providing the bleaching liquor;

an ager arranged downstream from the applicator;

a washing unit having a plurality of washing machines that includes a first series of washing machines adjacent to the ager and a last series of washing machines, said last series of washing machine having means to contain a flow of washing liquor flowing in a direction substantially opposite to the direction in which the fabric web is fed in the installation;

a line fluidically communicating with said last series of washing machines to provide washing liquor from the last series of washing machines to the first series of washing machines, said first series of washing machines having means to contain a flow of washing liquor flowing in a direction substantially the same as the direction in which the fabric web is fed in the installation.

4. The installation of claim 3 wherein said first series of washing machines has an intake fluidically communicating with a first end of said line, and further comprising a pump for removing a portion of the washing liquor from the end of the flow of washing liquor in the last series of washing machines and conducting said washing liquor portion to a second end of said line.

* * * * *